United States Patent [19]

Shaw et al.

[11] Patent Number: 5,019,286

[45] Date of Patent: May 28, 1991

[54] LOW VISCOSITY AROMATIC CARBONATE LUBRICATING OIL CONCENTRATES

[75] Inventors: Gerald Shaw, Plainfield; Paul K. Ladwig, Randolph, both of N.J.

[73] Assignee: Exxon Chemical Patents, Inc., Linden, N.J.

[21] Appl. No.: 484,289

[22] Filed: Feb. 26, 1990

[51] Int. Cl.[5] ..... C10M 141/02

[52] U.S. Cl. ..... 252/48.2; 252/52 R; 252/56 R; 252/51.5 R

[58] Field of Search ..... 252/56 R, 48.2, 52 R, 252/51.5 R

[56] References Cited

U.S. PATENT DOCUMENTS

| | | | |
|---|---|---|---|
| 2,340,331 | 2/1944 | Knutson et al. | 252/53 |
| 2,387,999 | 10/1945 | Knutson et al. | 252/54.6 |
| 2,739,121 | 3/1956 | Morway et al. | 252/41 |
| 2,871,191 | 1/1956 | Schott . | |
| 4,707,284 | 11/1987 | Goldblatt et al. | 252/32.7 |
| 4,801,391 | 1/1989 | Goldblatt et al. | 252/32.7 |
| 4,877,541 | 10/1989 | Wisotsky et al. | 252/51.5 A |

FOREIGN PATENT DOCUMENTS 0089709 9/1983 European Pat. Off. .

OTHER PUBLICATIONS

Smalheer et al, "Lubricant Additives", Lezius-Hiles Co., 1967 pp. 8-11.

*Primary Examiner*—Jacqueline V. Howard

*Attorney, Agent, or Firm*—J. B. Murray, Jr.; E. R. Skula

[57] ABSTRACT

According to the present invention, a process is provided for forming a lubricating oil concentrate containing aromatic carbonate which comprises admixing lubricating oil, aromatic carbonate and at least one aromatic carbonate solubilizing co-additive of the formula:

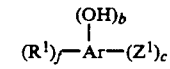

wherein $R^1$ is $C_1$ to $C_{20}$ substituted or unsubstituted hydrocarbyl, Ar is $C_6$ to $C_{20}$ aromatic group, and $Z^1$ is a member selected from the group consisting of —(O)-$COR^2$, —$N(R^3)$—$T^2$, —X—$T^1$, and —$D^1$—$T^3$ wherein $R^2$ is H or $C_1$ to $C_{20}$ hydrocarbyl, $R^3$ is H or $C_1$ to $C_6$ hydrocarbyl, $T^2$ is substituted or unsubstituted aryl, X is O or S, $T^1$ is group of the formula:

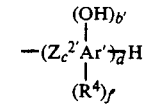

wherein Ar' is $C_6$ to $C_{20}$ aromatic group, $Z^2$ is divalent $C_1$ to $C_{10}$ alkylene or $C_3$ to $C_{10}$ cycloalkylene, $R^4$ is $C_1$ to $C_{20}$ substituted or unsubstituted hydrocarbyl, c' is 0 or 1, d is an integer of at least 1, and f' and b' are each integers of from 0 to 3, with the proviso that the sum of f' and b' does not exceed the unsatisfied valences of Ar', $D^1$ is a $C_1$ to $C_{10}$ hydrocarbon linking group and $T_3$ is an alkylene polyamine group, optionally substituted by one or more hydroxy-(optionally hydrocarby-substituted) aromatic groups, wherein f, b and c are each integers of from 0 to 3, with the proviso that the sum of f, b and c does not exceed the unsatisfied valences of Ar.

42 Claims, No Drawings

LOW VISCOSITY AROMATIC CARBONATE LUBRICATING OIL CONCENTRATES

FIELD OF THE INVENTION

This invention relates to lubricating oils, and more specifically to concentrates useful in formulating crankcase lubricating oils having improved anti-wear and friction reducing properties containing a basestock, a metal dialkyldithiophosphate, an aryl carbonate ester and a co-additive for improved solubilization of the aryl carbonate ester.

BACKGROUND OF THE INVENTION

Typically, in present-day lube oil formulations for internal combustion engines, phosphorus-containing compounds, such as zinc dialkyldithiophosphate (ZDDP), are added to the lube oil formulation to provide improved anti-wear properties. However, it has been found that phosphorus from phosphorus-containing compounds becomes deposited on the catalysts in catalytic converters, thereby decreasing the efficiency of catalytic converters over time. At the present time automotive lube oils typically contain a maximum of about 0.10 to about 0.14 wt. % phosphorus. To reduce the rate at which catalytic converters become fouled by phosphorus, it has been suggested that the maximum phosphorus content of lube oils be reduced to a range of about 0.05 to about 0.08 wt. %.

The use of carbonates in lubes oils is known. U.S. Pat. Nos. 2,340,331 and 2,387,999 disclose the use of diethyl, diamyl, dilauryl, diphenyl, dicresyl, di-o-cresyl, dibenzyl, mono-ethyl, and monophenyl carbonates in lube oils to increase the extreme pressure characteristics and reduce the rate of wear of lubricating oils.

European Patent Publication No. 89,709 discloses the use of organic carbonic esters of higher alcohols in lubricants for internal combustion engines. Wear and Coefficient of Friction test data are reported.

U.S. Patents 4,707,284 and 4,801,391 disclose lube oils having improved anti-wear properties wherein the lube oil comprises a basestock, diphenyl carbonate and a metal dialkyldithiophosphate salt. It is there disclosed that cyclic carbonates, such as ethylene carbonate, have relatively low solubility in lube oils, and are not preferred, and notes that the solubility of ethylene carbonate in basestock is about 0.04 wt. % at 25° C., while the solubility in a fully-formulated motor oil is about 0.2 wt. % at 25° C. The diphenyl carbonate of the patent is illustrated in fully-formulated lubricating oils containing viscosity index improver, antioxidant, dispersant, detergent and anti-foamant additives, with and without the addition of zinc dialkyldithiophosphate anti-wear additives.

While diphenyl carbonate possesses adequate solubility in fully-formulated lubricating oils, the formulation of lubricating oils conventionally involves the dissolution in a lubricating oil basestock of an additive package comprising a concentrate of the active ingredients, other than viscosity index improver, to prepare the fully-formulated oil.

U.S. Patents 4,707,284 and 4,801,391 disclose lubricating oils having improved anti-wear properties comprising basestock, a diphenyl carbonate and a metal dialkyldithiophosphate salt. The concentration of the diphenyl carbonate is given at from 0.1 to 1.5, relative to the basestock.

SUMMARY OF THE INVENTION

According to the present invention, a process is provided for forming a lubricating oil concentrate containing aromatic carbonate which comprises admixing lubricating oil, (A) aromatic carbonate and (B) at least one aromatic carbonate solubilizing co-additive of the formula:

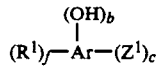

wherein $R^1$ is $C_1$ to $C_{20}$ substituted or unsubstituted hydrocarbyl, Ar is $C_6$ to $C_{20}$ aromatic group, and $Z^1$ is a member selected from the group consisting of —(O)-$COR^2$, —$N(R^3)$—$T^2$, —X—$T^1$, and —$D^1$—$T^3$ wherein $R^2$ is H or $C_1$ to $C_{20}$ hydrocarbyl, $R^3$ is H or $C_1$ to $C_6$ hydrocarbyl, $T^2$ is substituted or unsubstituted aryl, X is O or S, $T^1$ is a group of the formula:

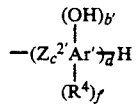

wherein Ar' is $C_6$ to $C_{20}$ aromatic group, $Z^2$ is divalent $C_1$ to $C_{10}$ alkylene or $C_3$ to $C_{10}$ cycloalkylene , $R^4$ is $C_1$ t o $C_{20}$ substituted or unsubstituted hydrocarbyl, c' is 0 or 1, d is an integer of at least 1, and f' and b' are each integers of from 0 to 3, with the proviso that the sum of f' and b' does not exceed the unsatisfied valence of Ar', $D^1$ is a $C_1$ to $C_{10}$ hydrocarbon linking group and $T^3$ is an alkylene polyamine group , optionally substituted by one or more hydroxy-(optionally hydrocarbyl-substituted) aromatic groups, wherein f, b and c are each integers of from 0 to 3, with the proviso that the sum of f, b and c does not exceed the unsatisfied valence of Ar.

In one preferred embodiment, the improved low viscosity lubricating oil concentrate of the present invention containing aromatic carbonate anti-wear additive is formed by contacting aromatic carbonate anti-wear additive in the presence of lubricating oil and at least oil soluble member selected from the group consisting of sulfurized alkyl phenols, alkylated diphenyl amines, phthalate esters, and Mannich Base nitrogen-containing dispersants.

It has been found that lubricating oil concentrates containing aromatic carbonate anti-wear additive and the solubilizing co-additives are characterized by substantially decreased viscosities, thereby improving the facility for handling such concentrates and providing advantageous properties to lubricating oil concentrates containing additional conventional lubricating oil additives.

DETAILED DESCRIPTION OF THE PREFERRED EMBODIMENT

According to the present invention, a process is provided for forming a lubricating oil concentrate containing aromatic carbonate which comprises admixing lubricating oil, (A) aromatic carbonate and (B) at least one aromatic carbonate solubilizing co-additive of the formula:

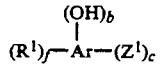

(I)

wherein $R^1$ is $C_1$ to $C_{20}$ substituted or unsubstituted hydrocarbyl, Ar is $C_6$ to $C_{20}$ aromatic group, and $Z^1$ is a member selected from the group consisting of —(O)-$COR^2$, —$N(R^3)$—$T^2$, —X—$T^1$, and —$D^1$—$T^3$ wherein $R^2$ is H or $C_1$ to $C_{20}$ hydrocarbyl, $R^3$ is H or $C_1$ to $C_6$ hydrocarbyl, $T^2$ is substituted or unsubstituted aryl, X is O or S, $T^1$ is a group of the formula:

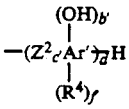

where in Ar' is $C_6$ to $C_{20}$ aromatic group, $Z^2$ is divalent $C_1$ to $C_{10}$ alkylene or $C_3$ to $C_{10}$ cycloalkylene , $R^4$ is $C_1$ to $C_{20}$ substituted or unsubstituted hydrocarbyl, c' is 0 or 1, d is an integer of at least 1, and f' and b' are each integers of from 0 to 3, with the proviso that the sum of f' and b' does not exceed the unsatisfied valence of Ar', $D^1$ is a $C_1$ to $C_{10}$ hydrocarbon linking group and $T^3$ is an alkylene polyamine g ro up , op tionally subst itu ted by on e or more hydroxy-(optionally hydrocarbyl-substituted) aromatic groups, wherein f, b and c are each integers of from 0 to 3, with the proviso that the sum of f, b and c does not exceed the unsatisfied valences of Ar.

AROMATIC CARBONATE

The aromatic carbonate additives employed in the present invention comprise compounds of the formula:

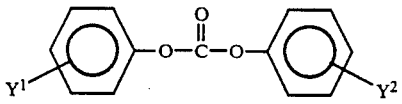

wherein $Y^1$ and $Y^2$ are the same or different and comprise a member selected from the group consisting of —H, —OH, —OM, hydrocarbyl, —$SO_3M$, and —$PO_3M$, wherein M is H or hydrocarbyl. When $Y^1$ and $Y^2$ or M are hydrocarbyl, the hydrocarbyl group will generally be from 1 to 10 (preferably from 1 to 6) carbon atoms, e.g., $C_1$ to $C_6$ alkyl (methyl, ethyl, propyl, butyl, pentyl, hexyl and the like). More preferably, $Y^1$ and $Y^2$ are each H. Examples of aromatic carbonates are

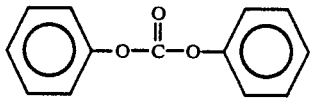

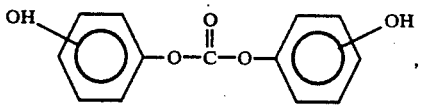

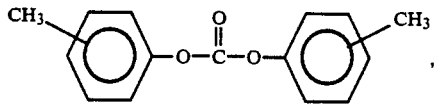

-continued

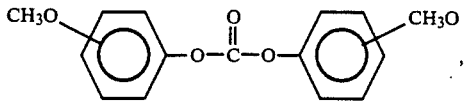

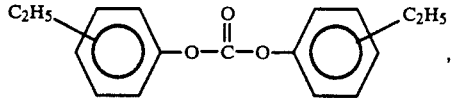

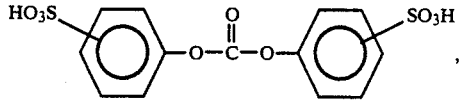

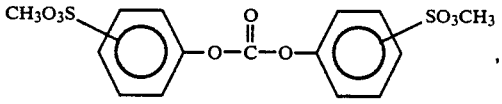

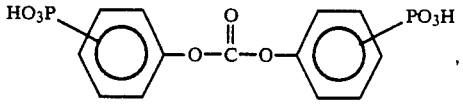

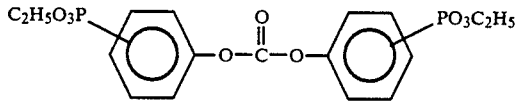

and the like.

CO-ADDITIVE B

One class (B-1) of additive B are aryl acid ester compounds of the formula:

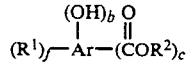

(II)

wherein $R^1$, Ar, $R^2$, f, b and c are as defined above. The B-1 compounds are esters of an aromatic carboxylic acid of the generic formula:

$R_m(Ar)\text{-}COOH)_n$ and a mono- or polyhydric alcohol of the formula:

$R'(OH)_s$ wherein m is 0 to 7, n is 1 to 6, Ar is an aromatic nucleus of 6 to 10 carbon atoms, R is a hydrocarbon-based group of up to about 40 carbon atoms, R' is a hydrocarbon-based group of up to 40 carbon atoms, and s is 1 to 6, with the p roviso that the total number of aliphatic and cycloaliphatic carbon atoms in R and R' is at least 6. Preferably m is 0 to 2, n is 2 to 4, s is 1 to 2 (more preferably n is 1 and s is 1), Ar is a phenyl or naphthyl nucleus of the valence, m and n, and R and R' are each independently aliphatic or alicyclic (more preferably alkyl, alkenyl, cycloalkyl or cycloalkenyl groups of up to about 20 carbon atoms) with the proviso that preferably the number of carbon atoms in R and R' total at least 12. Even more preferably $R'(OH)_s$ is a straight chain mono-hydric alkanol of up to 20 carbon atoms.

In the fullest scope of this invention the R and R' groups are hydrocarbon-based groups. As used herein, the term "hydrocarbon-based group" denotes a group having a preponderance of carbon and hydrogen atoms and having predominantly hydrocarbon character in the context of this invention. Such groups include the following:

(1) Hydrocarbon groups; that is aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such hydrocarbon groups are well known to those skilled in the art; examples include methyl, ethyl, propyl, isopropyl, butyl (normal, iso and tertiary), $C_5H_{11}$ (all isomers), $C_8H_{17}$ (all isomers), $C_{12}H_{25}$ (all isomers), etc. to $C_{40}H_{81}$, cyclohexyl, methylcyclohexyl (all isomers), cyclopentyl, ethyl cyclopentyl, decalinly, phenyl, tolyl, xylyl, benzyl, beta-phenyl ethyl, gamma propyl phenyl, etc. Ethylenically unsaturated analogs of these groups can also be present provided there is no more than one carbon-to-carbon ethylenic bond for every ten carbon-to-carbon single bonds in the group.

(2) Groups which, while predominantly hydrocarbon in character within the context of this invention, contain atoms other than hydrogen and carbon or substituents composed of such atoms and sometimes of carbon and hydrogen as well. Such atoms and substituents may be pendant to the main chain or enchained in it. The presence of these atoms and substituents does not alter the predominantly hydrocarbon character of the group. Those skilled in the art will be aware of suitable hetero atoms and substituents. Illustrative of such substituents are the following:

- pendant ether groups (especially hydrocarbyloxy and particularly alkoxy groups of up to ten carbon atoms)
- enchained oxa linkages (e.g., —O— linkages in a hydrocarbyl chain);
- nitro;
- cyano;
- fluoro;
- aromatic chlorine (i.e., chlorine bonded to a carbon of an aromatic nucleus);
- pendant thioether groups (especially $C_1$–$C_{10}$ alkyl thioethers such as methyl mercapto, butylmercapto, etc.);
- enchained thia linkages (e.g., —S— linkages in the main hydrocarbyl chain);
- pendant oxo groups;

$$\text{(e.g., CH, } \overset{O}{\overset{\|}{C}}\text{— and } C_6H_5\overset{O}{\overset{\|}{C}}\text{—)}$$

as well as enchained oxo function in the main chain $$\text{(e.g., } -CH_2CH_2-\overset{O}{\overset{\|}{C}}-(CH_2)_4-CH_2\text{)}$$

- pendant sulfonyl groups (—$SO_2$—) and enchained sulfonyl linkages;
- pendant sulfinyl groups (—SO—) and enchained sulfinyl linkages etc.,
- Other such non-hydrocarbyl atoms and substituents will be apparent to those skilled in the art.

Preferably, the hydrocarbon-based group R is purely hydrocarbyl in nature. More preferably, it is not present, i.e., m in Formula $R_m$—$(A_r)$—$(COOH)_n$ is zero, and the acid is a benzene or naphthalene-based carboxylic acid.

Illustrative aromatic carboxylic acids from which esters of this invention can be derived are the following:

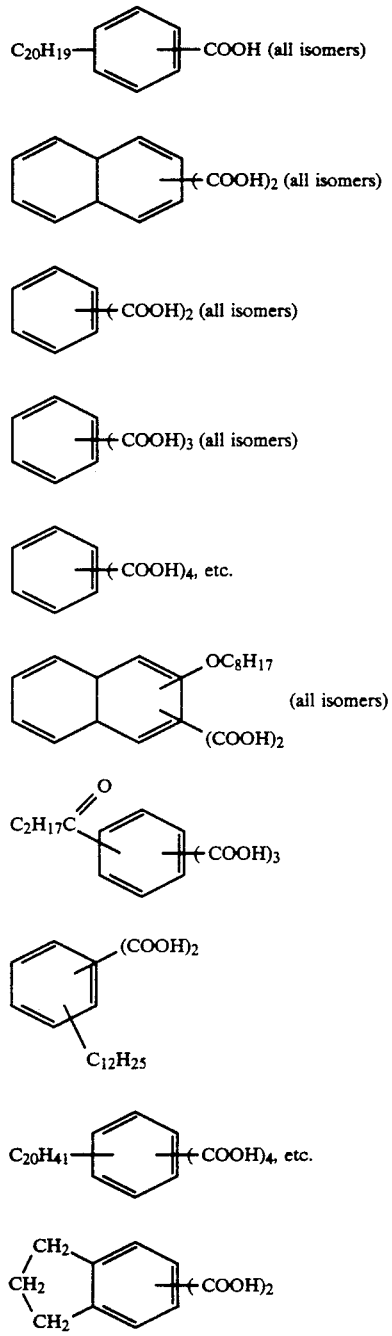

The B-1 esters can be derived from mixtures of one or more of these acids.

Preferably the B-1 esters for use in the compositions of this invention are derived from benzene and naphthalene carboxylic acids, more preferably they are benzene dicarboxylic acids such as phthalic, terphthalic and isophthalic acid.

The B-1 esters used in the lub ricant and concentrate compositions of the present invention are derived from the hereinbefore described aromatic carboxylic acids, and one or more mono- or polyhydric alcohols having up to six hydroxyl groups per molecule and of the formula:

$$R'(OH)_s$$

wherein R' is a hydrocarbon-based group of up to 40 carbon atoms and is of the same general nature as the R groups discussed above, with the exception that it is s-valent and can contain up to one ethylenic carbon-carbon bond per every carbon-carbon single bond. Exemplary monohydric alcohols R'OH are the following: methanol, ethanol, n-propanol, isopropanol, allyl alcohol, butanols (primary, secondary and tertiary, etc.), $C_5H_{10}OH$ (all isomers), $C_{11}H_{25}OH$ (all isomers), $C_{12}H_{23}OH$ (all isomers), cycl opentanol, ethyl cyclopentanol (all isomers), cyclohexanol, methyl cyclohexanol, cyclohexyl cyclohexanol, phenol, dodecenyl phenol, etc. up to $C_{40}H_{80}OH$. As noted above, straight chain alkanols of up to 20 carbon atoms are preferred, such as ethanol.

Typical polyhydric alcohols include alkylene glycols such as: ethylene glycol, propylene glycol, trimethylene glycol, butylene glycol, polyglycols, such as diethylene glycol, triethylene glycol, tetraethylene glycol, dipropylene glycol, tripropylene glycol, dibutylene glycol, tributylene glycol, etc.

Other useful polyhydric alcohols include glycerol, monomethyl ether of glycerol, pentaerythritol, neopentyl glycol, trimethylol propane, the ethyl ester of 9,10-dihydroxy stearic acid, 1,2-propanediol, 1,4-propanediol, 2,3-hexanediol, 2,4-hexanediol, erythritol, 1,2-cyclohexanediol, 1,4-cyclohexanediol, 2 - (hydroxyethyl)-1,4-cyclohexanediol, 1,4-dihydroxy-2-nitrodecane, etc.

Preferably, the alcohols used to produce the esters of the present invention are monohydric aliphatic or alicyclic alcohols of up to 20 carbon atoms and contain no non-hydrocarbyl substituents. Primary monohydric alkanols of up to 20 carbons are among the more preferred alcohols.

The preparation of such aromatic carboxylic acid esters is well-known to those of skill in the art. A number of such techniques are disclosed in the following: U.S. Pat. Nos. 2,936,320; 2,956,870; 3,019,188; 3,021,357; 3,637,501.

These patents are hereby incorporated by reference for their disclosures relevant to the production of aromatic carboxylic acid esters.

Generally, it is preferable that one equivalent aromatic acid and one equivalent of alcohol be used to form B-1 ester for use in the compositions of this invention (an equivalent of acid or its molecular weight divided by the number of reactive-carboxyl groups and an equivalent of an alcohol is similarly calculated from the number of hydroxyl groups present. For example, phthalic acid (or anhydride) has two equivalents per mole, ethanol one equivalent per mole and 4-(2-hydroxyethyl) phenol two equivalents per mole). It is possible, however, with polyhydric alcohols equivalent of acid to form esters having unesterified hydroxyl groups.

As is well-known in the art, it is not necessary to use only free acids and alcohols to form esters; functional equivalents such as acid anhydrides, acid salts, acid halides, metal alcoholates, hydrocarbon halides, and the like can be used. Similarly, ester exchanges between esters of lower molecular weight alcohols and higher molecular weight alcohols can be advantageously used in certain circumstances.

The lubricant and concentrate compositions of this invention are prepared by conventional blending and mixing techniques well-known to those of skill in the art.

Preferred additives B-1 are those of the formula

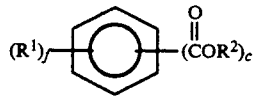

(III)

wherein f is 0 or 1, and c is an integer of from 1 to 4, more preferably 1 or 2, and wherein $R^2$ is $C_4$ to $C_{15}$ hydrocarbyl. Examples of such preferred B-1 additives are butyl phthalate, dipentyl phthalate, dihexyl phthalate, diheptyl phthalate, dioctyl phthalate, di(2-ethylhexyl) phthalate, dinonyl phthalate, didecyl phthalate, didodecyl phthalate, di(tridecyl) phthalate, and the like.

Another class (B-2) of additive B are compounds of the formula:

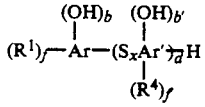

(IV)

wherein b and b' are the same and are each 0, 1 or 2, x is a number of from 1 to 4 (preferably 1 to 3, more preferably 1 or 2), Ar' , $R^1$, $R^4$ and $Z^1$ are as defined above, and f and f' are the same and are each 0, 1 or 2.

Preferred as B-2 additives in the compositions of this invention is at least one oil soluble sulfurized alkyl-substituted hydroxyaromatic compound. Sulfurized alkyl-substituted hydroxyaromatic compounds and the methods of preparing them are known in the art and are disclosed, for example, in the following U.S. Pat. Nos. (which are incorporated by reference herein): 2,139,766; 2,198,828; 2,230,542; 2,836,565; 3,285,854; 3,538,166; 3,844,956; 3,951,830; and 4,115,287.

In general, the sulfurized alkyl-substituted hydroxyaromatic compounds may be prepared by reacting an alkyl-substituted hyd roxyaromatic compound with a sulfurizing agent such as elemental sulfur, a sulfur halide (e.g., sulfur monochloride or sulfur dichloride), a mixture of hydrogen sulfide and sulfur dioxide, or the like. The preferred sulfurizing agents are sulfur and the sulfur halides, and especially the sulfur chlorides, with sulfur dichloride ($SCl_2$) being especially preferred.

The alkyl-substituted hydroxyaromatic compounds which are sulfurized are generally compounds containing at least one hydroxy group (e.g., from 1 to 3 hydroxy groups) and at least one alkyl radical (e.g., from to 3 alkyl radicals) attached to the same aromatic ring. The alkyl radical ordinarily contains about 3-100 and preferably about 6-20 carbon atoms. The alkyl-substituted hydroxyaromatic compound may contain more than one hydroxy group as exemplified by alkyl resorcinols, hydroquinones and catechols, or it may contain more than one alkyl radical; but normally it contains only one of each. Compounds in which the alkyl and hydroxy groups are ortho, meta and para to each other, and mixtures of such compounds, are within the scope of the invention. Illustrative alkyl-substituted hydroxyaromatic compounds are n-propylphenol, isopropylphenol, n-butylphenol, t-butylphenol, hexylphenol, heptylphenol, octylphenol, nonylphenol, n-dodecyl-phenol,(propene tetramer)-substituted phenol, octadecylphenol, eicosylphenol, polybutene (molecular weight about 1000)-substituted phenol, n-dodecylresorcinol and 2,4-di-t-butylphenol, and the alkyl-substituted catechols corresponding to the foregoing. Also included are methylene-bridged alkyl-substituted hydroxyaromatic compounds of the type which may be prepared by the reaction of an alkyl-substituted hydroxyaromatic compound with formaldehyde or a formaldehyde-yielding reagent such as trioxane or paraformaldehyde.

The sulfurized alkyl-substituted hydroxyaromatic comp oun d is typ ically prepared by reacting the alkyl-substituted hydroxyaromatic compound with the sulfurizing agent at a temperature within the range of about 100°-250° C. The reaction may take place in a substantially inert diluent such as toluene, xylene, petroleum naphtha, mineral oil, Cellosolve or the like. If the sulfurizing agent is a sulfur halide, and especially if no diluent is used, it is frequently preferred to remove acidic materials such as hydrogen halides by vacuum stripping the reaction mixture or blowing it with an inert gas such as nitrogen. If the sulfurizing agent is sulfur, it is frequently advantageous to blow the sulfurized product with an inert gas such as nitrogen or air so as to remove sulfur oxides and the like.

Preferred B-2 additives are compounds of the formula:

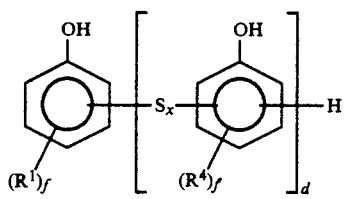

(V)

wherein f and f' are the same and are each 1 or 2, x is a number of from 1 to 4 (preferably from 1 to 3, most preferably 1 or 2), $R^1$ and $R^4$ are independently $C_4$ to $C_{14}$ alkyl, and d is an integer of from 1 to 4. Examples of such B-2 additives are compounds of Table A below:

TABLE A (Compounds of Formula V)

| f | $R^1$ | d | f' | $R^4$ |
|---|---|---|---|---|
| 2 | n-butyl | 1 | 2 | n-butyl |
| 2 | sec-butyl | 1 | 2 | sec-butyl |
| 2 | tert-butyl | 1 | 2 | tert-butyl |
| 1 | octyl | 1 | 2 | octyl |
| 1 | nonyl | 1 | 2 | nonyl |
| 1 | 2-ethyl hexyl | 1 | 2 | 2-ethyl hexyl |
| 1 | decyl | 1 | 2 | decyl |
| 1 | dodecyl | 1 | 2 | dodecyl |
| 1 | tridecyl | 1 | 2 | tridecyl |
| 1 | octyl | 2 | 2 | octyl |
| 1 | nonyl | 2 | 2 | nonyl |
| 1 | 2-ethyl hexyl | 2 | 2 | 2-ethyl hexyl |
| 1 | decyl | 2 | 2 | decyl |
| 1 | dodecyl | 2 | 2 | dodecyl |
| 1 | tridecyl | 2 | 2 | tridecyl |

Another class (B-3) of additives B are compounds of the formula:

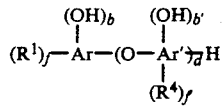

(VI)

wherein b and B40 are the same and are each 0, 1 or 2, Ar', $R^1$, $R^4$ and $Z^1$ are as defined above, and f and f' are the same and each 0, 1 or 2. Preferred B-3 additives are compounds of the formula:

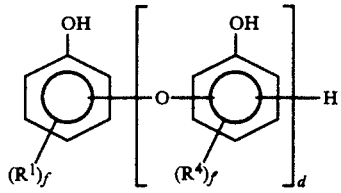

(VII)

wherein f and f' are the same and are each 0, 1 or 2, $R^1$ and $R^4$ are independently $C_4$ to $C_{14}$ alkyl, and d is an integer of from 0 to 4. Examples of such B-3 additives are compounds of Table B below:

TABLE B (Compounds of Formula VII)

| f | $R^1$ | d | f' | $R^4$ |
|---|---|---|---|---|
| 2 | n-butyl | 1 | 2 | n-butyl |
| 2 | sec-butyl | 1 | 2 | sec-butyl |
| 2 | tert-butyl | 1 | 2 | tert-butyl |
| 1 | octyl | 1 | 2 | octyl |
| 1 | nonyl | 1 | 2 | nonyl |
| 1 | 2-ethyl hexyl | 1 | 2 | 2-ethyl hexyl |
| 1 | decyl | 1 | 2 | decyl |
| 1 | dodecyl | 1 | 2 | dodecyl |
| 1 | tridecyl | 1 | 2 | tridecyl |
| 1 | octyl | 2 | 2 | octyl |
| 1 | nonyl | 2 | 2 | nonyl |
| 1 | 2-ethyl hexyl | 2 | 2 | 2-ethyl hexyl |
| 1 | decyl | 2 | 2 | decyl |
| 1 | dodecyl | 2 | 2 | dodecyl |
| 1 | tridecyl | 2 | 2 | tridecyl |

Another class (B-4) of additives B are compounds of the formula:

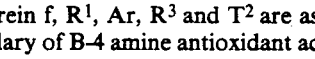

$(R^1)_f$—AR—N($R^3$)-$T^2$ (VIII)

wherein f, $R^1$, Ar, $R^3$ and $T^2$ are as defined above. Exemplary of B-4 amine antioxidant additives useful in this invention are phenyl-substituted and phenylene-substituted amines, N-nitro phenyl hydroxylamine, isoindoline compounds, phosphinodithioic acid-vinyl carboxylate adducts, phosphorodithioate ester-aldehyde reaction products, phosphorodithioate-alkylene oxide reaction products silyl esters of terephthalic acid, bis-1,3-alkylamino-2-propanol, anthranilamide compounds, anthranilic acid esters, alpha-methyl styrenated aromatic amines, aromatic amines and substituted benzophenones, aminoguanidines, peroxide-treated phenothiazine, alkyl-substituted phenothiazines, alkylated diphenylamines, 4-alkylphenyl-1-alkyl-2-naphthylamines, dibenzazepine compounds, fluorinated aromatic amines, alkylated polyhydroxy benzenoid compounds, substituted indans, dimethyl octadecylphosphonate-arylimino dialkanol copolymers and substitutued benzodiazoborole, N,N'-diisopropyl-p-phenylenediamine; N,N'-di-sec-butyl-p-phenylenediame; N,N'-bis-(1,4-dimethylpentyl)-p-phenylenediame; N,N'-bis(1-ethyl-3-methylpentyl)-p-phenylenediamine; N,N'-bis(1-methylheptyl)-p-phenylenediamine; N,N'-diphenyl-p-phenylenediamine; N,N'-di(napthyl-2)-p-phenylenediamine; N-isopropyl-N'-phenyl-p-phenylenediamine; N-(1,3-dimethylbutyl)-N'-phenyl-n-phenylenediamine; N-(1-methylheptyl)-N'-phenyl-p-phenylenediamine ; N-cyclohexyl-N'-phenyl-p-phenylenediamine; 4-(p-toluenesulfonamido)diphenylamine; N,N'-dimethyl-N,N '-di-sec-butyl-p-phenylenediamine diphenylamine; 4-isopropoxydiphenylamine ; N-phenyl-1-naphthylamine; N-phenyl-2-naphthylamine; octylated diphenylamine ; 4-n-butylaminophenol ; 4-butyrylaminophenol ; 4-nonanoylaminophenol ; 4-dodecanoylaminophenol; 4-octadecanoylaminophenol; di-(4-methoxyphenyl)amine; 2,6- di-tert-butyl-4-dimethylaminomethylphenol; 2,4'-diaminodiphenylmethane; 4,4'-diaminophenylmethane; N,N,N',N'-tetramethyl-4,4'-diaminodiphenylmethane; 1,2-di[(2-methylphenyl)amineo]ethane; 1,2 -di(-phenylamino)propane; (o-tolyl)biguanide; di[4-(1',3'-dimethylbutyl)phenyl]amine; tert-octylated N-phenyl-1-napthylamino: and mixture of mono- and dialkylated tert-butyl-/tert-octyldiphenylamines.

Preferred B-4 additives are compounds of the formula:

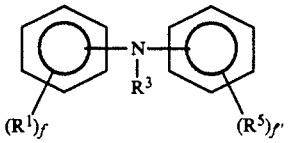

(IX)

wherein f, $R^1$ and $R^3$ are as defined above, f' is an integer of 0 to 3, and $R^5$ is $C_1$ to $C_{20}$ substituted or unsubstituted hydrocarbyl.

Additives B-5 comprise Mannich Base dispersant materials having the general formula

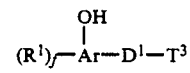

(X)

wherein f, $R^1$, Ar, $D^1$ and $T^3$ are as defined above.

Nitrogen containing dispersants which contain Mannich base or Mannich condensation products are known in the art. Such Mannich condensation products generally are prepared by condensing about 1 mole of a high molecular weight hydrocarbyl substituted hydroxy aromatic compound (e.g., having a number average molecular weight of 700 or greater) with about 1 to 2.5 moles of an aldehyde such as formaldehyde or paraformaldehyde and about 0.5 to 2 moles polyalkylene polyamine as disclosed, e.g., in U.S. Pat. Nos. 3,442,808; 3,649,229; and 3,798,165 (the disclosures which are hereby incorporated by reference in their entirety). Such Mannich condensation products may include a long chain, high molecular weight hydrocarbon on the phenol group or may be reacted with a compound containing such a hydrocarbon, e.g., polyalkenyl succinic anhydride as shown in said aforementioned U.S. Pat. No. 3,442,808.

The optionally substituted hydroxy aromatic compounds used in the preparation of the Mannich base products include those compounds having the formula $$R^{21}{}_y\text{Aryl-(OH)}_z \qquad \text{(XI)}$$

wherein Aryl represents

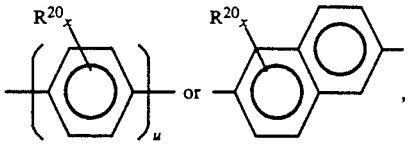

wherein u is 1 or 2, $R^{21}$ is a long chain hydrocarbon, $R^{20}$ is a hydrocarbon or substituted hydrocarbon radical having from 1 to about 3 carbon atoms or a halogen radical such as the bromide or chloride radical, y is an integer from 1 to 2, x is an integer from 0 to 2, and z is an integer from 1 to 2.

Illustrative of such Aryl groups are phenylene, biphenylene, naphthylene and the like.

The long chain hydrocarbon $R^{21}$ substituents are olefin polymers. Preferred are olefin polymers comprising a major molar amount of $C_2$ to $C_{10}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Mixtures of polymers prepared by polymerization of mixtures of isobutylene, butene-1 and butene-2, e.g., polyisobutylene wherein up to about 40% of the monomer units are derived from butene-1 and butene-2, is an exemplary, and preferred, olefin polymer. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will generally have number average molecular weights of from about 1,000 and about 5,000, preferably from about 1,150 to 4,000, more preferably from about 1300 and about 3,000, and still more preferably from about 1,500 and about 3,000. particularly useful olefin polymers have number average molecular approximately one terminal double bond per polymer chain. An especially useful starting material for highly potent dispersant additives useful in accordance with this invention is polyisobutylene, wherein up to about 40% of the monomer units are derived from butene-1 and/or butene-2. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

The olefin polymers will generally have a molecular weight distribution (the ratio of the weight average molecular weight to number average molecular weight, i.e. $\overline{M}_w/\overline{M}_n$) of from about 1.0 to 4.5, and more typically from about 1.5 to 3.0.

Processes for substituting the hydroxy aromatic compounds with the olefin polymer are known in the art and may be depicted as follows (Eq. 1):

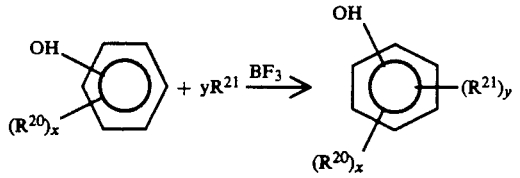

where $R^{20}$, $R^{21}$, y and x are as previously defined, and BF3 is an alkylating catalyst. Processes of this type are described, for example, in U.S. Pat. Nos. 3,539,633 and 3,649,229, the disclosures of which are incorporated herein by reference.

Representative hydrocarbyl substituted hydroxy aromatic compounds contemplated for use in the present invention include, but are not limited to, 2-polypropylene phenol, 3-polypropylene phenol, 4-polypropylene phenol, 2-polybutylene phenol, 3-polyisobutylene phenol, 4-polyisobutylene phenol, 4-polyisobutylene-2-chlorophenol, 4-polyisobutylene-2-methylphenol, and the like.

Suitable hydrocarbyl-substitued polyhydroxy aromatic compounds include the polyolefin catechols, the polyolefin resorcinols, and the polyolefin hydroquinones, e. g., 4-polyisobutylene-1,2-dihydroxybenzene, 3-polypropylene-1,2-dihydroxybenzene, 5-polyisobutylene-1,3-dihydroxybenzene, 4-polyamylene-1,3-dihydroxybenzene, and the like.

Suitable hydrocarbyl-substituted naphthols include 1-polyisobutylene-5-hydroxynaphthalene, 1-polypropylene-3-hydroxynaphthalene and the like.

The preferred long chain hydrocarbyl substituted hydroxy aromatic compounds to be used in forming a Mannich Base product for use in this invention can be illustrated by the formula:

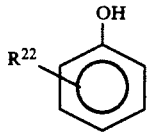

(XII)

wherein $R^{22}$ is hydrocarbyl of from 50 to 300 carbon atoms, and preferably is a polyolefin derived from a $C_2$ to $C_{10}$ (e.g., $C_2$ to $C_5$) mono-alpha-olefin.

The aldehyde material which can be employed in the production of the Mannich base is represented by the formula:

$$R^{23}CHO \qquad \text{(XIII)}$$

in which $R^{23}$ is hydrogen or an aliphatic hydrocarbon radical having from to 4 carbon atoms. Examples of suitable aldehydes include formaldehyde, paraformaldehyde, acetaldehyde and the like.

The polyamine materials which can be employed may be hydrocarbyl amines or may be hydrocarbyl amines including other groups, e.g., hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

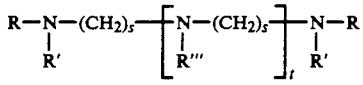

(XIV)

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkyle ne radicals; $C_2$ to $C_1$ 2 hydroxy amino alkylene radicals; and $C_1$ to $C_{12}$ alkylamino $C_2$ to $C_6$ alkylene radicals; and wherein R''' can additionally comprise a moiety of the formula:

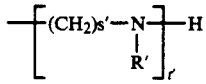

(XV)

wherein R' is as defined above, and wherein s and s' can be the same or a different number of from 2 to 6, preferably 2 to 4; and t and t' can be the same or different and are numbers of from 0 to 10, preferably 2 to 7, and most preferably about 3 to 7, with the proviso that the sum of t and t' is not greater than 15. To assure a facile reaction, it is preferred that R, R', R'', R''', s, s', t and t' be selected in a manner sufficient to provide the compounds of Formula XIV with typically at least one primary or secondary amine group, preferably at least two primary or secondary amine groups. This can be achieved by selecting at least one of said R, R', R'' or R''' groups to be hydrogen or by letting t in Formula XIV be at least one when R''' is H or when the XV moiety possesses a secondary amino group. The most preferred amine of Formula XIV contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; 1,2-propylene diamine; di-(1,2-propylene)triamine; di-(1,3-propylene) triamine; N,N-dimethyl-1,3-diaminopropane; N,N-di-(2-aminoethyl) ethylene diamine; N,N-di(2-hydroxyethyl)-1,3-propylene diamine; 3-dodecyloxypropylamine; N-dodecyl-1,3-propane diamine; tris hydroxymethylaminomethane (THAM) ; diisopropanol amine: diethanol amine; triethanol amine; mono-, di-, and tri-tallow amines; amino morpholines such as N-(3-aminopropyl)morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general formula (XVI):

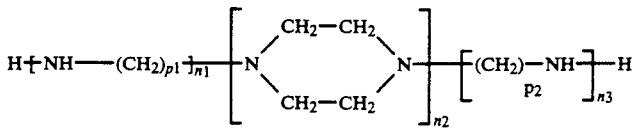

wherein $p_1$ and $p_2$ are the same or different and are each integers of from 1 to 4, and $n_1$, $n_2$ and $n_3$ are the same or different and are each integers of from 1 to 3. Non-limiting examples of such amines include 2-pentadecyl imidazoline; N-(2-aminoethyl) piperazine; etc.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric p iperazine s. Low cost poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

$$NH_2\text{—alkylene}\left(\text{O—alkylene}\right)_m NH_2 \quad \text{(XVII)}$$

where m has a value of about 3 to 70 and preferably 10 to 35; and $$R\left(\text{alkylene}\left(\text{O—alkylene}\right)_n NH_2\right)_a \quad \text{(XVIII)}$$

where "n" has a value of about 1 to 40 with the provision that the sum of all the n's is from about 3 to about 70 and preferably from about 6 to about 35, and R is a polyvalent saturated hydrocarbon radical of up to ten carbon atoms wherein the number of substituents on the R group is represented by the value of "a", which is a number of from 3 to 6. The alkylene groups in either Formula (XVII) or (XVIII) may be straight or branched chains containing about 2 to 7, and preferably about 2 to 4 carbon atoms.

The polyoxyalkylene polyamines of Formulas (XVII) or (XVIII) above, preferably polyoxyalkylene diamines and polyoxyalkylene triamines, may have average molecular weights ranging from about 200 to about 4000 and preferably from about 400 to about 2000. The preferred polyoxyalkylene polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

Additional amines useful in the present invention are described in U.S. Pat. No. 3,445,441, the disclosure of which is hereby incorporated by reference in its entirety.

A particularly useful class of amines are the polyamido and related amines disclosed in U.S. Pat. No. 4,857,217, the disclosure of which is hereby incorporated by reference, which comprise reaction products of a polyamine and an alpha, beta unsaturated compound of the formula:

$$D^5\text{—}\overset{D^6}{\overset{|}{C}}\text{=}\overset{D^7}{\overset{|}{C}}\text{—}\overset{X}{\overset{\|}{C}}\text{—Y} \quad \text{(XIX)}$$

wherein X is sulfur or oxygen, Y is —$OD^8$, —$SD^8$, or —$ND^8(D^9)$, and $D^5$, $D^6$, $D^7$, $D^8$ and $D^9$ are the same or different and are hydrogen or substituted or unsubstituted hydrocarbyl.

The additive B will be employed in an amount effective to solubilize the amount of aromatic carbonate employed inthe presence of the selected amount of lubricating oil to provide the low viscosity mixturse of the present invention. The amount of the aromatic carbonate and aromatic carbonate solubilziing co-additive in the lubricating oil concentrates of the present invention can vary widely, depending on such factors as the particular Additive B used, the temperature, the amount of lubricating oil employed, and other factors, but will be generally present in the following weight:weight ratios:

| Weight Parts Aromatic Carbonate Per Weight Part of: | | | |
|---|---|---|---|
| | B-1 | Monoalkyl(1) B-2 | Dialkyl(2) B-2 |
| Broad | 0.01–5.7 | 0.01–0.22 | 0.01–9.0 |
| Preferred | 0.05–3.0 | 0.04–0.15 | 0.5–5.0 |
| | B-3 | B-4 | B-5 |
| Broad | 0.01–0.22 | 0.01–9.01 | 0.01–0.18 |
| Preferred | 0.04–0.14 | 0.5–5.0 | 0.04–0.15 |

(1)Compounds of Formula (IV) wherein $f = f^1 = 0$ or 1.
(2)Compounds of Formula (IV) wherein $f = f^1 = 2$.

The low viscosity mixtures of the present invention will generally contain from about 5 to 50 wt. %, preferably from 10 to 40 wt. % and more preferably from 15 to 30 wt. % lubricating oil, which is preferably a hydrocarbon lubricating oil. The lubricating oil, aromatic carbonate and additive (B) will be generally admixed at temperatures of from about 20° to 100° C., preferably from 60° to 85° C., for a time of from 0.5 to 8 hours, preferably from 2 to 6 hours, to form the low viscosity compositions of the present invention.

The aromatic carbonate exists as a solid at ambient conditions and can be charged in any form, although powder or slake forms are preferred for ease of handling. The lubricating oil and additives (A) and (B) cna be charged to the mixing zone in any orer and any of these materials may be premixed (e.g., premixes of the oil and additive (A) or (B)).

The low viscosity mixtures prepared by the process of this invention are particularly suitable for use in crankcase lubricating oil compositions containing a metal salt of a dihydrocarbyldithiophosphate, preferably a zinc salt of a dialkyldithiophosphate as antiwear agent, such as described in U.S. Pat. Nos. 4,707,284 and 4,801,391, the disclosures of which are incorporated by reference in their entirety. The metal dialkyldithiophosphate will typically contain alkyl groups of from 2 to 10 carbon atoms, preferably from 3 to 8 carbon atoms, with zinc dialkyldithiophosphates being preferred.

The lubricating oil additives prepared by the process of this invention, as described above, have advantageously improved viscosity properties and are useful as lubricating oil additives in internal combustion carnkcase lubricating oils (e.g., automotive engines, which are fueled by gasoline, methanol, diesel and other conventional fuels). Accordingly, the additives can be used by incorporation and dissolution into an oleaginous material such as fuels and lubricating oils. When the additives of this invention are used in normally liquid petroleum fuels such as middle distillates boiling from about 65° to 43020 C., including kerosene, diesel fuels, home heating fuel oil, jet fuels, etc., a concentration of the additives in the fuel in the range of typically from about 0.001 to about 0.5, and preferably 0.005 to about 0.15 weight percent, based on the total weight of the composition, will usually be employed.

The additives of the present invention find their primary utility in lubricating oil compositions which employ a base oil in which the additive is dissolved or dispersed. Such base oils may be natural or synthetic. Base oils suitable for use in preparing the lubricating oil compositions of the present invention include those conventionally employed as carnkcase lubricating oils for spark-ignited and compression-ignited internal combustion engines, such as automobile and truck engines, marine and railroad diesel engines, and the like. Advantageous results are also achieved by employing the additives of the present invention in base oils conventionally employed in and/or adapted for use as power transmitting fluids such as automatic transmission fluids, tractor fluids, universal tractor fluids and hydraulic fluids, heavy duty hydraulic fluid, power steering fluids and the like. Gear lubricants, industrial oils, pump oils and other lubricating oil compositions can also benefit from the incorporation therein of the additives of the present invention.

These lubricating oil formulations conventionally contain several different types of additives that will supply the characteristics that are required in the formulations. Among these types of additives are included viscosity index improvers (e.g., ethylene-propylene copolymer VI improvers, dispersant-viscosity improver polymers, and the like), supplemental antioxidants, corrosion inhibitors, detergents (e.g., neutral or basic (including overbased) alkali and alkaline earth metal salts of alkyl phenates, sulfurized alkyl phenates, alkylsulfonic acids, etc.), dispersants (e.g., high molecular weight ashless nitrogen- and ester-containing dispersants, such as polyisobutenyl succinimides, and the borated derivatives thereof), pour point depressants, other antiwear agents, friction modifeirs (e.g., glycerol oleates), etc. Suitable such other additives for use in combination with the additives of the present invention are disclosed in U.S. Pat. Nos. 4,113,539; 4,172,540; 4,388,201; 4,502,970; and 4,797,219, the disclosure of each of which is hereby incorporated by reference in its entirety.

The process of this invention can be further illustrated by reference to the following examples wherein parts are by weight unless otherwise indicated.

EXAMPLES

EXAMPLES 1-8

In a series of experiments, diphenyl carbonate solid (DPC) was dissolved with mixing at both ambient temperature (25° C.) or at 66° C. in S150N lubricating oil solutions containing the indicated solubilziing co-additive selected from commercial sulfurized alkyl phenol antioxidants, diphenyl amine antioxidants and aromatic Mannich Base dispersants. The resulting solutions were then stored in the temperature indicated below and were observed to determine the solubility of the DPC, the DPC's crystallization point and the liquid concentrate's flowability. The data thereby obtained are set forth in Table I below.

TABLE I

| Example No. | Solubility Limit (Wt. % DPC) 25° C. | 66° C. | Solubilizing Co-additive |
|---|---|---|---|
| Base oil(1) | <5 | 10-15 | None |
| 1 | 5-10 | 30 | Nonyl phenol sulfide(2) |
| 2 | 15-20 | 80-85 | Dihexyl phthalate(3) |
| 3 | 10-15 | 85-90 | Diphenyl amine(4) |
| 4 | 20-25 | 85-90 | Di(tert-butyl)phenol sulfide(5) |
| 5 | 10-20 | 20-35 | Mannich dispersant(6) |

(1)S150N mineral oil.
(2)72 wt. % soln. of bis(nonyl phenol) sulfide in S150N lubricating oil.
(3)neat.
(4)80 wt. % soln. of di(nonyl phenol)NH in mineral oil.
(5)neat.
(6)50 wt. % soln. of nitrogen containing Mannich base dispersant in mineral oil.

EXAMPLES 6-11

Diphenyl carbonate was admixed with S150N lubricating oil and bis(nonyl-phenol) monoamine antioxidant, dihexyl phthalate seal swell additive or bis(di-tertiary butyl phenol) sulfide antioxidant in the indicated proportions and the kinematic viscosity was then determined of the resulting mixture. This kinematic viscosity was also determined for the lubricating oil mixture containing only the selected solubilizing co-additive without diphenyl carbonate. The data thereby obtained are set forth in Table II below.

TABLE II

| Example No. | Co-additive | DPC | Wt/Wt Co-additive: DPC | Kinematic Viscosity @ 100° C. cSt. |
|---|---|---|---|---|
| 6 | di($C_9$-$\phi$)amine(1) | No | — | 21.23 |
| 7 | di($C_9$-$\phi$)amine(1) | Yes | 80:20 | 7.69 |
| 8 | dihexyl phthalate(2) | No | — | 3.16 |
| 9 | dihexyl phthalate | Yes | 70:30 | 2.63 |
| 10 | bis[di($C_4$)$\phi$]sulfide(3) | No | — | 7.78 |
| 11 | bis[di($C_4$)$\phi$]sulfide(3) | Yes | 70:30 | 4.37 |

(1)bis(nonyl-phenyl) monoamine. (80 wt. % a.i. in mineral oil)
(2)neat.
(3)sulfurized di-tert-butyl phenol neat.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A low viscosity aromatic carbonate lubricating oil concentrate which comprises lubricating oil, aromatic carbonate and an aromatic carbonate solubilizing effective amount of at least one oil soluble co-additive selected from the group consisting of compounds of the formula:

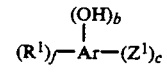

wherein $R^1$ is $C_1$ to $C_{20}$ substituted or unsubstituted hydrocarbyl, Ar is $C_6$ to $C_{20}$ aromatic group, and $Z^1$ is a member selected from the group consisting of —(O)-$COR^2$, —$N(R^3)$—$T^2$, —X—$T^1$, and —$D^1$—$T^3$ wherein $R^2$ is H or $C_1$ to $C_{20}$ hydrocarbyl, $R^3$ is H or $C_1$ to $C_6$ hydrocarbyl, $T^2$ is substituted or unsubstituted aryl, X is O or S, $T^1$ is a group of the formula:

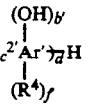

wherein Ar' is $C_6$ to $C_{20}$ aromatic group, $Z^2$ is divalent $C_1$ to $C_{10}$ alkylene or $C_3$ to $C_{10}$ cycloalkylene , $R^4$ is $C_1$ t o $C_{20}$ substituted or unsubstituted hydrocarbyl, c' is 0 or 1, d is an integer of at least 1, and f' and b' are each integers of from 0 to 3, with the proviso that the sum of f' and b' does not exceed the unsatisfied valence of Ar', $D^1$ is a $C_1$ to $C_{10}$ hydrocarbon linking group and $T^3$ is an alkylene polyamine group , optionally substituted by one or more hydroxy-(optionally hydrocarbyl-substituted) aromatic groups, wherein f, b and c are each integers of from 0 to 3, with the proviso that the sum of f, b and c does not exceed the unsatisfied valence of Ar.

2. The concentrate according to claim 1 wherein said aromatic carbonate comprises diphenyl carbonate.

3. The concentrate according to claim 1 wherein said aromatic carbonate is present in said concentrate in an amount of from about 1 to 25 wt. % and wherein said lubricating oil comprises a major portion of said concentrate.

4. The concentrate according to claim 1 wherein said co-additive comprises at least one compound of the formula:

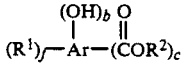

wherein $R^1$, Ar, $R^2$, f, b and c are as defined above.

5. The concentrate according to claim 1 wherein said co-additive comprises at least one compound of the formula:

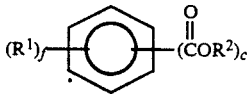

wherein f is 0 or 1, and c is an integer of from 1 to 4, more preferably 1 or 2, and wherein $R^2$ is $C_4$ to $C_{15}$ hydrocarbyl.

6. The concentrate according to claim 5 wherein said co-additive comprises at least one member selected from the group consisting of butyl phthalate, dipentyl phthalate, dihexyl phthalate, diheptyl phthalate, dioctyl phthalate, di(2-ethylhexyl) phthalate, dinonyl phthalate, didecyl phthalate, didodecyl phthalate and di(tridecyl) phthalate.

7. The concentrate according to any of claims 4–6 wherein said aromatic carbonate and said co-additive are present in an aromatic carbonate:co-additive weight:weight ratio of from about 0.1:1 to 5.7:1.

8. The concentrate according to claim 7 wherein said ratio is from 0.5:1 to 3.0:1.

9. The concentrate according to claim 1 wherein said co-additive comprises at least one compound of the formula:

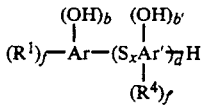

wherein b and b' are the same and are each 0, 1 or 2, x is a number of from to 4, Ar', $R^1$, $R^4$ and $Z^1$ are as defined above, and f and f' are the same and are each 0, 1 or 2.

10. The concentrate according to claim 1 wherein said co-additive comprises at least one compound of the formula:

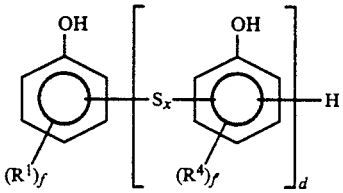

wherein f and f' are the same and are each 1 or 2, x is a number of from 1 to 4, $R^1$ and $R^4$ are independently $C_4$ to $C_{14}$ alkyl, and d is an integer of from 0 to 4.

11. The concentrate of claim 10 wherein x is a number of from 1 to 3 and b is 1.

12. The concentrate according to any of claims 9–11 wherein said aromatic carbonate and said co-additive are present in an aromatic carbonate:co-additive weight:weight ratio of from about 0.01:1 to 9.0:1.

13. The concentrate according to claim 10 wherein f is 2, b is 1 or 2, and wherein said aromatic carbonate and said co-additive are present in an aromatic carbonate:-co-additive weight:weight ratio of from 0.01:1 to 9.0:1.

14. The concentrate according to claim 10 wherein f is 1, b is 1 or 2, and wherein said aromatic carbonate and said co-additive are present in an aromatic carbonate:-co-additive weight:weight ratio of from 0.01:1 to 0.22:1.

15. The concentrate according to claim 1 wherein said co-additive comprises at least one compound of the formula:

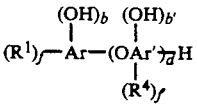

wherein b and b' are the same and are each 0, 1 or 2, Ar', $R^1$, $R^4$ and $Z^1$ are as defined above, and f and f' are the same and are each 0, 1 or 2.

16. The concentrate according to claim 15 wherein said aromatic carbonate and said co-additive are present in an aromatic carbonate:co-additive weight:weight ratio of from 0.01:1 to 0.22:1.

17. The concentrate according to claim 1 wherein said co-additive comprises at least one compound of the formula:

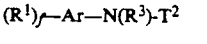

wherein f, $R^1$, Ar, $R^3$ and $T^2$ are as defined above.

18. The concentrate according to claim 1 wherein said co-additive comprises at least one compound of the formula:

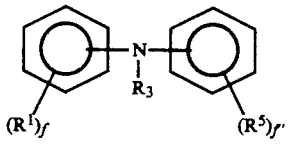

wherein f, $R^1$ and $R^3$ are as defined above, f' is an integer of 0 to 3, and $R^5$ is $C_1$ to $C_{20}$ substituted or unsubstituted hydrocarbyl.

19. The concentrate according to claim 17 or 18 wherein said aromatic carbonate and said co-additive are present in an aromatic carbonate:co-additive weight:weight ratio of from about 0.01:1 to 9.0:1.

20. The concentrate according to claim 1 wherein said co-additive comprises a Mannich Base dispersant of the formula

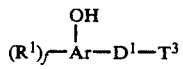

wherein f, $R^1$, $D^1$ and $T^3$ are as defined above.

21. The concentrate according to claim 1 wherein said aromatic carbonate and said co-additive are present in an aromatic carbonate:co-additive weight:weight ratio of from about 0.01:1 to 9.0:1.

22. A process for forming a low viscosity aromatic carbonate lubricating oil concentrate which comprises admixing lubricating oil, aromatic carbonate and an aromatic carbonate solubilizing effective amount of at least one oil soluble co-additive selected from the group consisting of compounds of the formula:

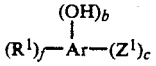

wherein $R^1$ is $C_1$ to $C_{20}$ substituted or unsubstituted hydrocarbyl, Ar is $C_6$ to $C_{20}$ aromatic group, and $Z^1$ is a member selected from the group consisting of —(O)-$COR^2$, —$N(R^3)$—$T^2$, —X—$T^1$, and —$D^1$—$T^3$ wherein $R^2$ is H or $C_1$ to $C_{20}$ hydrocarbyl, $R^3$ is H or $C_1$ to $C_6$ hydrocarbyl, $T^2$ is substituted or unsubstituted aryl, X is O or S, $T^1$ is a group of the formula:

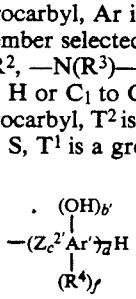

wherein Ar' is $C_6$ to $C_{20}$ aromatic group, $Z^2$ is divalent $C_1$ to $C_{10}$ alkylene or $C_3$ to $C_{10}$ cycloalkylene , $R^4$ is $C_1$ t o $C_{20}$ substituted or unsubstituted hydrocarbyl, c' is 0 or 1, d is an integer of at least 1, and f' and b' are each integers of from 0 to 3, with the proviso that the sum of f' and b' does not exceed the unsatisfied valence of Ar', $D^1$ is a $C_1$ to $C_{10}$ hydrocarbon linking group and $T^3$ is an alkylene polyamine group, optionally substituted by one or more hydroxy-(optionally hydrocarbyl-substituted) aromatic groups, wherein f, b and c are each integers of from 0 to 3, with the proviso that the sum of f, b and c does not exceed the unsatisfied valence of Ar.

23. The process according to claim 22 wherein said aromatic carbonate comprises diphenyl carbonate.

24. The process according to claim 22 wherein said aromatic carbonate is present in said concentrate in an amount of from about 1 to 25 wt. % and wherein said lubricating oil comprises a major portion of said concentrate.

25. The process according to claim 22 wherein said co-additive comprises at least one compound of the formula:

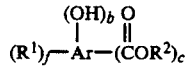

wherein $R^1$, Ar, $R^2$, f, b and c are as defined above.

26. The process according to claim 22 wherein said co-additive comprises at least one compound of the formula:

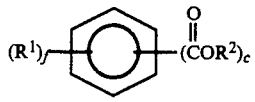

wherein f is 0 or 1, and c is an integer of from 1 to 4, more preferably 1 or 2, and wherein $R^2$ is $C_4$ to $C_{15}$ hydrocarbyl.

27. The process according to claim 26 wherein said co-additive comprises at least one member selected from the group consisting of butyl phthalate, dipentyl phthalate, dihexyl phthalate, diheptyl phthalate, dioctyl phthalate, di(2-ethylhexyl) phthalate, dinonyl phthalate, didecyl phthalate, didodecyl phthalate and di(tridecyl) phthalate.

28. The process according to any of claims 25–27 wherein said aromatic carbonate and said co-additive are present in an aromatic carbonate:co-additive weight:weight ratio of from about 0.1:1 to 5.7:1.

29. The process according to claim 28 wherein said ratio is from 0.5:1 to 3.0:1.

30. The process according to claim 22 wherein said co-additive comprises at least one compound of the formula:

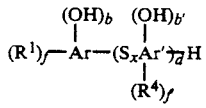

wherein b and b' are the same and are each 0, 1 or 2, x is a number of from to 4, Ar' , $R^1$, $R^4$ and $Z^1$ are as defined above, and f and f' are the same and are each 0, 1 or 2.

31. The process according to claim 22 wherein said co-additive comprises at least one compound of the formula

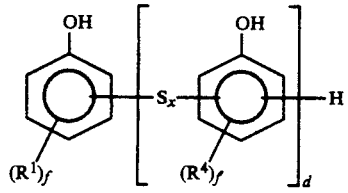

where f and f' are the same and are each 1 or 2, x is a number of from 1 to 4, $R^1$ and $R^4$ are independently $C_4$ to $C_{14}$ alkyl, and d is an integer of from 0 to 4.

32. The process of claim 31 wherein x is a number of from 1 to 3 and b is 1.

33. The process according to any of claims 30–32 wherein said aromatic carbonate and said co-additive are present in an aromatic carbonate:co-additive weight:weight ratio of from about 0.01:1 to 9.0:1.

34. The process according to claim 31 wherein f is 2, b is 1 or 2, and wherein said aromatic carbonate and said co-additive are present in an aromatic carbonate:co-additive weight:weight ratio of from 0.01:1 to 9.0:1.

35. The process according to claim 31 wherein f is 1, b is 1 or 2, and wherein said aromatic carbonate and said co-additive are present in an aromatic carbonate:co-additive weight:weight ratio of from 0.01:1 to 0.22:1.

36. The process according to claim 22 wherein said co-additive comprises at least one compound of the formula:

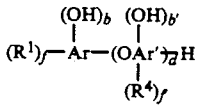

wherein b and b' are the same and are each 0, 1 or 2, Ar', $R^1$, $R^4$ and $Z^1$ are as defined above, and f and f' are the same and are each 0, 1 or 2.

37. The process according to claim 36 wherein said aromatic carbonate and said co-additive are present in an aromatic carbonate:co-additive weight:weight ratio of from 0.01:1 to 0.22:1.

38. The process according to claim 22 wherein said co-additive comprises at least one compound of the formula:

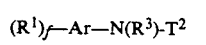

wherein f, $R^1$, Ar, $R^3$ and $T^2$ are as defined above.

39. The process according to claim 22 wherein said co-additive comprises at least one compound of the formula:

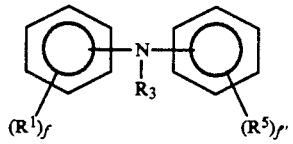

wherein f, $R^1$ and $R^3$ are as defined above, f'' is an integer of 0 to 3, and $R^5$ is $C_1$ to $C_{20}$ substituted or unsubstituted hydrocarbyl.

40. The process according to claim 38 or 39 wherein said aromatic carbonate and said co-additive are present in an aromatic carbonate:co-additive weight:weight ratio of from about 0.01:1 to 9.0:1.

41. The process according to claim 22 wherein said co-additive comprises a Mannich Base dispersant of the formula

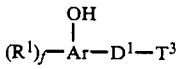

wherein f, $R^1$, $D^1$ and $T^3$ are as defined above.

42. The process according to claim 22 wherein said aromatic carbonate and said co-additive are present in an aromatic carbonate:co-additive weight:weight ratio of from about 0.01:1 to 9.0:1.

* * * * *